US005758808A

United States Patent [19]

Epps et al.

[11] Patent Number: 5,758,808

[45] Date of Patent: Jun. 2, 1998

[54] CANE POSITIONING STRAP

[76] Inventors: Roselyn Payne Epps, 1775 N. Portal, Washington, D.C. 20012; Roselyn E. Epps, 907 6th St. SW. #807 C, Washington, D.C. 20024

[21] Appl. No.: 758,311

[22] Filed: Dec. 2, 1996

Related U.S. Application Data

[63] Continuation of Ser. No. 504,385, Jul. 19, 1995, abandoned.

[51] Int. Cl.[6] ..... A45F 3/14

[52] U.S. Cl. ..... 224/257; 224/258; 224/250; 135/66; 24/304; 294/150

[58] Field of Search ..... 224/148.6; 2/912, 2/920; 24/304; 128/876, 877, 878, DIG. 15, DIG. 26; 135/65, 66

[56] References Cited

U.S. PATENT DOCUMENTS

| | | | |
|---|---|---|---|
| 702,398 | 6/1902 | Bower | 224/250 |
| 975,430 | 11/1910 | Humma et al. | 224/250 |
| 2,710,639 | 6/1955 | Farls | 224/600 |
| 3,259,285 | 7/1966 | Bush | 224/600 |
| 3,279,663 | 10/1966 | Torres | 224/602 |
| 3,970,316 | 7/1976 | Westmoreland, Jr. | 128/878 |
| 4,440,334 | 4/1984 | Kappel et al. | 224/258 |
| 4,470,528 | 9/1984 | Dyess | 224/257 |
| 4,751,923 | 6/1988 | Marino | 128/878 |
| 4,863,083 | 9/1989 | Chen | 224/250 |
| 4,979,659 | 12/1990 | Boyd | 224/603 |
| 5,119,910 | 6/1992 | Heggeland | 224/901 |
| 5,174,481 | 12/1992 | Ledune . | |
| 5,203,482 | 4/1993 | Puff | 224/257 |
| 5,318,209 | 6/1994 | Rader et al. | 224/258 |
| 5,383,587 | 1/1995 | Carpenter | 224/917 |
| 5,395,855 | 3/1995 | Schaiewitz | 224/250 |
| 5,400,937 | 3/1995 | Rottenberg | 224/603 |
| 5,431,319 | 7/1995 | Cavadini et al. | 224/258 |
| 5,450,991 | 9/1995 | Neading | 224/257 |
| 5,492,254 | 2/1996 | Challoner et al. | 224/257 |
| 5,505,356 | 4/1996 | Noriega et al. | 224/651 |
| 5,622,292 | 4/1997 | Dorney | 224/148.6 |

FOREIGN PATENT DOCUMENTS

| | | | |
|---|---|---|---|
| 167201 | 2/1934 | Switzerland | 224/917 |

*Primary Examiner*—Henry T. Recla
*Assistant Examiner*—Gregory M. Vidovich
*Attorney, Agent, or Firm*—Pennie & Edmonds LLP

[57] ABSTRACT

A strap for positioning a cane when it is not in use includes a retaining strap adapted to be secured around a cane and a flexible sling strap secured to the retaining strap and defining a sling for positioning or retrieving the cane. A releasable fastening member is secured to the retaining strap and adjustable between an open and closed position wherein the retaining strap is secured around the cane in the closed position.

15 Claims, 2 Drawing Sheets

CANE POSITIONING STRAP

This application is a continuation of application Ser. No. 08/504,385, filed Jul. 19, 1995, now abandoned.

BACKGROUND OF THE INVENTION

1. Field of the Invention

The present invention relates generally to a positioning strap and, more particularly, to a strap for positioning and retrieving a cane, or other elongated object when the object is not in use.

2. Description of the Related Art and Object of the Invention

Straps of the type generally relating to the present invention include straps for carrying luggage, bags, skis and other objects. Typically, these devices include a shoulder sling and a hook device to attach the strap to the object to be carried.

One example of a strap device known in the art is U.S. Pat. No. 5,174,481 which discloses a bat strap or carrier for carrying a baseball bat, baseball and mitt(s). The carrier includes a collapsible pocket made from a plurality of cloth webs and adapted to receive a baseball and the upper end of a bat. An elongated strap extends from the pocket and has a mitt strap for retaining a baseball mitt and a bat strap for retaining the lower end of the bat.

Another strap device is shown in U.S. Pat. No. 5,203,482. This strap device is for carrying heavy objects about a shoulder and comprises a foldable middle section which spreads over and around the shoulder to distribute the weight of a heavy load. The foldable middle section may also be folded to form a conventional uniform width shoulder strap.

Neither of these strap devices address the problem of positioning a cane, umbrella or other elongated object which is difficult to position, particularly when not in use. Rather, the above devices are directed to transporting or carrying an object, not positioning it when the object is not in use.

Notwithstanding the foregoing disclosures, there presently exists a need for a device which will position a cane or other elongated object such that it can be easily retrieved from its resting position when necessary. Advances in medicine have resulted in an aging population which is living to greater ages and is increasingly relying on assisted living devices to improve the quality of their lives. One problem frequently encountered by a cane user is what to do with the cane when it is not in use, i.e., when the user sits down. Resting the cane on a table, wall, or other structure is not always helpful as it can be in the way and easily falls. Resting a cane on the floor is not a solution, as the handicapped or elderly often find it difficult to reach to the floor and to retrieve an object on the floor. Of course, the positioning device must also be compact so that when the cane is in use, the carrier is not itself a handicap or a hazard.

Accordingly, it is an object of the present invention to provide a cane strap for positioning a cane when it is not in use.

SUMMARY OF THE INVENTION

The subject invention is directed to a strap or carrier for positioning and easily retrieving a cane, umbrella or other elongated object which is difficult to position when not in use. The strap includes a retaining strap and a sling strap, both preferably formed of a nylon or cotton webbing. The sling strap has upper and lower ends and is connected at its lower end to the retaining strap.

The upper end of the sling strap is generally U-shaped to ride over and around the object, such as a chair, arm or shoulder from which the cane is positioned when not in use. The sling strap is of such a length that it can be easily hung over an object, such as a chair, and further may include a strap length adjustment device.

The lower end of the sling strap terminates in a pair of ends which are fixedly attached together by sewing a seam, so that the sling strap forms a closed loop-like structure. The lower pair of ends are fixedly attached to he middle section of the retaining strap by sewing a seam hereto.

The retaining strap has first and second ends which are oppositely positioned relative to middle section of the retaining strap. The retaining strap also has an outer surface and an inner surface against which the cane is placed when the carrier is in use. A releasable fastener is positioned on the retaining strap to enable the retaining strap to be secured around the cane. In the first preferred embodiment, the fastener is a Velcro® fastener formed by hook and loop pads oppositely attached on the first and second ends of the retaining straps.

In use, the upper portion of the cane is inserted against the inner portion of the retaining strap. The first and second ends of the retaining strap are then brought into overlapping alignment to engage the fastener. The upper end of the sling strap is then looped over and hung from a chair, hook or other object.

In a further preferred embodiment, the releasable fastener is a snap type fastener.

BRIEF DESCRIPTION OF THE DRAWING

The accompanying drawings, referred to herein and constituting a part hereof, illustrate preferred embodiments of the present invention, and together with the description, serve to explain the principles of the invention.

DETAILED DESCRIPTION OF THE PREFERRED EMBODIMENTS

Figure 1:
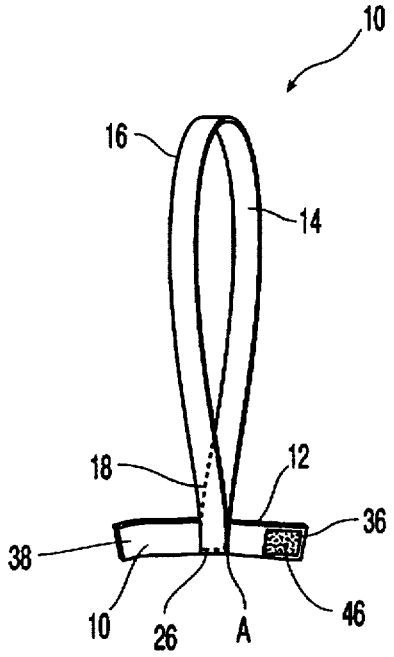
FIG. 1 is a front perspective view of the cane strap.
Figure 2:
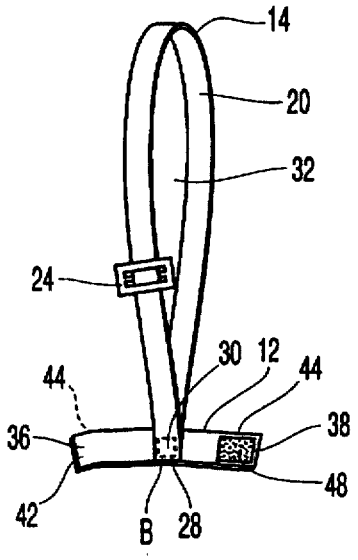
FIG. 2 is a rear perspective view of the cane strap of FIG. 1.

Referring now to FIGS. 1 and 2, there is shown a cane strap device 10 having a retaining strap 12 and a sling strap 14. The sling strap 14 includes upper and lower ends 16, 18 and is connected at its lower end 18 to the retaining strap 12. The retaining strap 12 and sling strap 14 are preferably made of a nylon or cotton webbing, but as appreciated by those in the art could also be made of leather, cord or other flexible and durable material.

The upper end 16 of the sling strap 14 is generally U-shaped 20 to ride over and around an object, such as a chair, bed post, hook, arm or shoulder from which the cane strap 10 is suspended or positioned when it is not in use. The sling strap 14 is, preferably, of such a length, measured from end A to end B, that the sling strap 14 can be easily hung over the object from which the cane is suspended. The sling strap 14 could also include a conventional strap length adjustment device 24, such as is shown in FIG. 2, comprising a rectangular slide formed as a rectangular frame member having a tongue extending across the middle of the frame member, that permits length adjustment of the sling strap 14. Alternatively, a releasable fastener, such as a Velcro®-type fastener could be attached to the sling strap 14 to permit adjustment of its length, and specifically the size of the loop-like structure 32 discussed below.

The lower end 18 of the sling strap 14 terminates in end portions 26, 28 which are fixedly attached together by seam 30, or by other known means such as a rivet or adhesive to form a closed, loop-like structure 32 of sling strap 14. The end portions 26, 28 are fixedly attached to the retaining strap 12 by the seam 30, or by another seam or other known means of attachment. Alternatively, the sling strap 14 could be a unitary annular member which would be attached to the retaining strap 12 also by sewing a seam.

Figure 3:
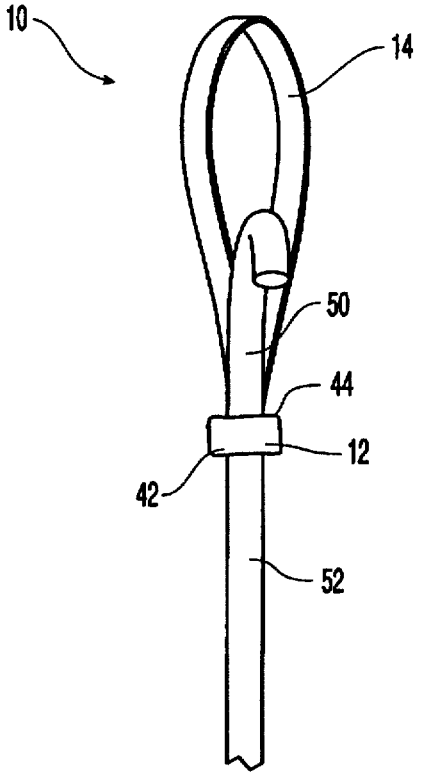
FIG. 3 is a front perspective view of a cane shown retained in the cane strap of FIGS. 1 and 2.

The retaining strap 12 has a first end 36, an oppositely positioned second end 38, an inner surface 40 and an outer surface 42. The first and second ends 36, 38 are each provided with a releasable and adjustable fastener 44, such as a Velcro® fastener, which in the preferred embodiment shown here includes a hook pad 46 and loop pad 48. It will be appreciated by those skilled in the art that the ability of the fastener 44 to be adjustable enables the retaining strap to accommodate various cane widths. As shown in FIGS. 1 and 2, the inner surface 40 of first end 36 has a hook pad 46 and the outer surface 42 of second end 38 has a loop pad 48 disposed thereon, although as will be appreciated by those skilled in the art, the placement of the hook and loop pads 46,48 on the first and second ends 36, 38 are interchangeable. As shown in FIG. 3, when the upper portion 50 of the cane 52 is placed in the retaining strap 12, the first and second ends 36, 38 are secured tightly around the cane 52 by means of the fastener 44.

Figure 5:
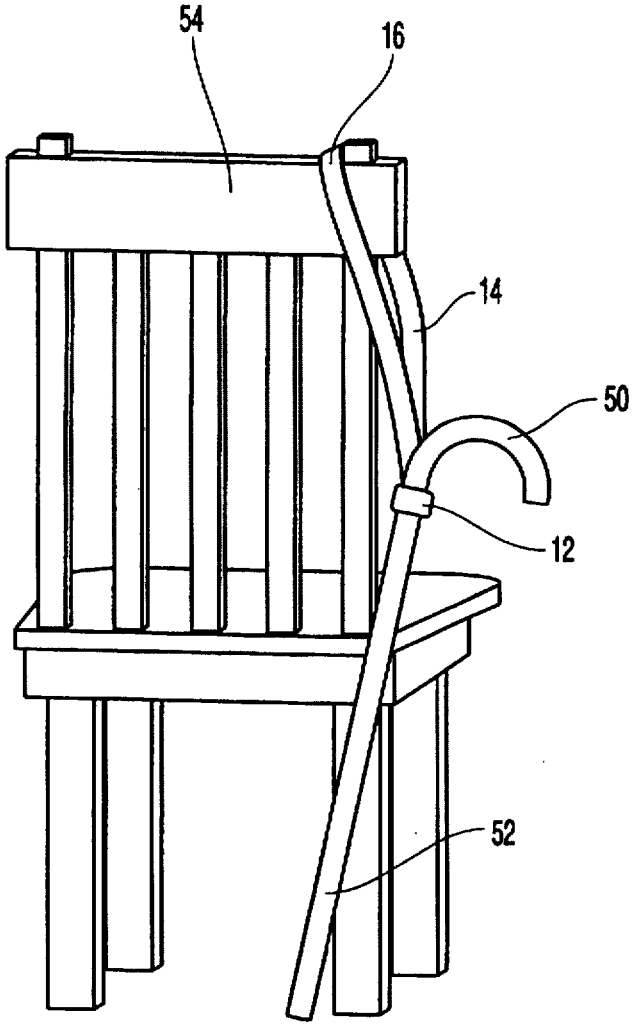
FIG. 5 is a perspective view of the cane strap showing a cane positioned therein and hanging over the back of a chair.

In use, the upper portion 50 of the cane 52 is placed along the inner surface 40 of the retaining strap 12. The first and second ends 36 and 38 of the retaining strap 12 are then brought into overlapping position such that the fastener 44 is engaged. As shown in FIG. 5, the cane strap 10 may then be positioned over a chair 54, a hook or other object. Further, when the cane 52 is in use, the retaining strap 12 may remain engaged around the upper portion 50 of the cane 52 and the user's hand may be inserted through the sling strap 14 to grip the cane 52.

Figure 4:
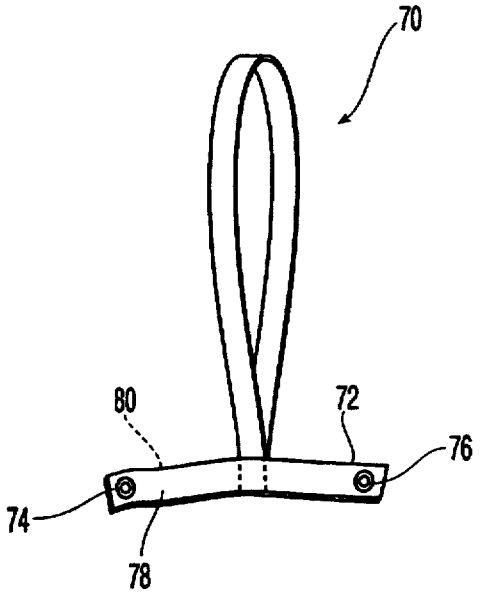
FIG. 4 is a front perspective view of an alternative embodiment of the cane strap.

In a further preferred embodiment shown in FIG. 4, a cane strap 70 is provided with a snap 72 having cooperating snap pads 74, 76 respectively positioned on inner surface 78 and outer surface 80.

To the extent not already indicated, it will be understood by those of ordinary skill in the art that any one of the various specific embodiments herein described and illustrated may be further modified to incorporate features shown in other of the specific embodiments, as desired. By way of example only, it will be understood that the sling and retaining straps could be formed of an integral piece of material, rather than as shown herein. Furthermore, the retaining strap could be an annular, unitary and resilient member secured to the sling strap and movable between a first position in which it is securely engaged around the cane and a second stretched position which would permit the cane to be received and positioned within the retaining strap about the cane.

The invention in its broader aspects therefore is not limited to the specific embodiments herein shown and described, but departures may be made therefrom within the scope of the accompanying claims without departing from the principles of the invention and without sacrificing its chief advantages.

We claim:

1. A strap for positioning a walking cane when it is not in use and retrieving the walking cane for use, comprising:

a retaining strap adapted to be secured around a walking cane;

a releasable fastening member secured to said retaining strap and adjustable between an open and closed position, wherein said retaining strap is secured around the walking cane in said closed position; and a flexible sling strap having two opposite free ends defining a sling length therebetween, said ends overlapping each other and being immovably secured to said retaining strap and defining a sling with a closed loop structure for positioning the walking cane, wherein said retaining strap is positioned at the lower end of the loop structure of said sling strap.

2. A strap of claim 1, wherein said releasable fastening member includes a pair of mating members oppositely positioned on said retaining strap.

3. A strap of claim 1, further comprising an adjustment member to adjust the length of said sling strap.

4. A strap of claim 1, wherein said sling strap is sized and configured to receive a hand therethrough.

5. A strap of claim 1, wherein said sling strap is a one-piece member.

6. A strap of claim 1, wherein said sling strap extends substantially perpendicularly from said retaining strap.

7. A strap of claim 1 wherein the retaining strap forms a closed loop structure in its closed position, the closed loop of the retaining strap being smaller than that of the sling strap.

8. A strap of claim 1 wherein the retaining strap and the sling strap are made of flexible materials.

9. A strap of claim 8 wherein the retaining strap and the sling strap are made of nylon materials.

10. A strap of claim 8 wherein the retaining strap and the sling strap are sewed together.

11. A strap of claim 1 wherein the retaining strap and the sling strap are perpendicularly joined.

12. A strap of claim 1 wherein the both ends of the sling strap are connected in the middle portion of the retaining strap.

13. A method for positioning a walking cane when it is not in use comprising the following steps:

providing a positioning strap having a retaining strap adapted to be secured around a walking cane, a releasable fastening member secured to said retaining strap and adjustable between an open and closed position, wherein said retaining strap is secured around the walking cane in said closed position, and a flexible sling strap having two opposite free ends defining a sling length therebetween, said ends overlapping each other and being immovably secured to said retaining strap and defining a sling with a closed loop structure for positioning the walking cane, wherein said retaining strap is positioned at the lower end of the closed loop structure of said sling strap;

securing the retaining strap around a walking cane; and placing the sling strap over a support, whereby the combination of the positioning strap and the walking cane is positioned on the support.

14. A combination of a walking cane and a strap comprising:

a walking cane having a bent top;

a retaining strap adapted to be secured around the walking cane;

a releasable fastening member secured to said retaining strap and adjustable between an open and closed position, wherein said retaining strap is secured around the walking cane in said closed position; and a flexible sling strap having two opposite free ends defining a sling length therebetween, said ends overlapping each other and being immovably secured to said retaining strap and defining a sling with a closed loop, structure for positioning the walking cane, wherein said retaining strap is positioned at the lower end of the loop structure of said sling strap.

15. In a strap for positioning a walking cane when it is not in use and retrieving the walking cane for use, a retaining strap being adapted to be secured around the walking cane, a releasable fastening member being secured to said retaining strap and adjustable between an open and closed position, wherein said retaining strap is secured around the walking cane in said closed position and a flexible sling strap having two opposite free ends defining a sling length therebetween, wherein the improvement comprising:

said opposite ends overlapping each other and being immovably secured to said retaining strap defining a sling with a closed loop structure for positioning the walking cane, wherein said retaining strap is positioned at the lower end of the loop structure of said sling strap.

* * * * *